US011315481B2

(12) United States Patent
Gao et al.

(10) Patent No.: US 11,315,481 B2
(45) Date of Patent: Apr. 26, 2022

(54) PIXEL CIRCUIT AND ITS DRIVE METHOD, DISPLAY PANEL, AND DISPLAY DEVICE

(71) Applicants: BOE MLED Technology Co., Ltd., Beijing (CN); BOE Technology Group Co., Ltd., Beijing (CN)

(72) Inventors: Yankai Gao, Beijing (CN); Ming Chen, Beijing (CN); Lingyun Shi, Beijing (CN); Xin Duan, Beijing (CN); Yuxin Bi, Beijing (CN); Hong Liu, Beijing (CN); Mingjian Yu, Beijing (CN); Guofeng Hu, Beijing (CN)

(73) Assignees: BOE MLED Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 97 days.

(21) Appl. No.: 16/754,914

(22) PCT Filed: Nov. 14, 2019

(86) PCT No.: PCT/CN2019/118489
§ 371 (c)(1),
(2) Date: Apr. 9, 2020

(87) PCT Pub. No.: WO2020/244155
PCT Pub. Date: Dec. 10, 2020

(65) Prior Publication Data

US 2021/0407377 A1 Dec. 30, 2021

(30) Foreign Application Priority Data

Jun. 4, 2019 (CN) ..... 201910481916.6

(51) Int. Cl.
*G09G 3/32* (2016.01)

(52) U.S. Cl.
CPC ..... *G09G 3/32* (2013.01); *G09G 2300/0408* (2013.01); *G09G 2300/0465* (2013.01);
(Continued)

(58) Field of Classification Search
CPC ..... G09G 2300/0465; G09G 3/32; G09G 2300/0408; G09G 2300/0809;
(Continued)

(56) References Cited

U.S. PATENT DOCUMENTS

2005/0156828 A1* 7/2005 Yamashita ..... G09G 3/3258 345/76
2013/0134889 A1* 5/2013 Chen ..... H05B 45/3725 315/193
(Continued)

FOREIGN PATENT DOCUMENTS

CN 108877674 A 11/2018
CN 109272940 A 1/2019
(Continued)

*Primary Examiner* — Muhammad N Edun
(74) *Attorney, Agent, or Firm* — Ipro, PLLC

(57) ABSTRACT

Disclosed includes an apparatus, a drive method, a display panel, and a display device. The apparatus may comprise a drive transistor, a light emitting device driven by the drive transistor and a comparator. The comparator may have a first input coupled to a pixel voltage, a second input coupled to a reference voltage, a first control terminal coupled to a first control voltage, a second control terminal coupled to a second control voltage, and an output coupled to a gate of the drive transistor. The comparator may be configured to output the first control voltage to the output during a first time period in which the pixel voltage is not smaller than the reference voltage and output the second control voltage to the output during a second time period in which the pixel voltage is smaller than the reference voltage.

20 Claims, 7 Drawing Sheets

(52) U.S. Cl.
CPC ..... *G09G 2300/0809* (2013.01); *G09G 2300/0842* (2013.01); *G09G 2310/08* (2013.01); *G09G 2320/045* (2013.01)

(58) Field of Classification Search
CPC ..... G09G 2300/0842; G09G 2310/08; G09G 2320/045
See application file for complete search history.

(56) References Cited

U.S. PATENT DOCUMENTS

| | | | | |
|---|---|---|---|---|
| 2017/0188427 | A1* | 6/2017 | Cok | G09G 3/2003 |
| 2018/0295690 | A1* | 10/2018 | Chen | H05B 45/3575 |
| 2020/0105193 | A1 | 4/2020 | Qing | |
| 2020/0312223 | A1 | 10/2020 | Yuan et al. | |

FOREIGN PATENT DOCUMENTS

| | | | |
|---|---|---|---|
| CN | 109754756 | A | 5/2019 |
| CN | 109830208 | A | 5/2019 |
| CN | 110148376 | A | 8/2019 |
| KR | 101953797 | B1 | 3/2019 |
| KR | 20190054354 | A | 5/2019 |

* cited by examiner

PIXEL CIRCUIT AND ITS DRIVE METHOD, DISPLAY PANEL, AND DISPLAY DEVICE

CROSS-REFERENCE TO RELATED APPLICATION

This application claims priority to Chinese Patent Application No. 201910481916.6, filed on Jun. 4, 2019, the contents of which are incorporated by reference in the entirety.

TECHNICAL FIELD

Disclosed herein relates to the field of display technology, particularly relates to a pixel circuit and its drive method, display panel, and display device.

BACKGROUND

Micro Light Emitting Diode display (Micro LED) is widely regarded as the next generation of display technology, because of its high brightness, ultra-high resolution and color saturation, and its advantages of low power consumption, long life, fast response, and high efficiency, compared to organic light emitting diode (OLED).

Micro LED includes an array substrate which generally comprising a substrate. By integrating a high-density, small-sized LED array on the substrate, LEDs are thinned, miniaturized, and metricized. Micro LED may emit light individually and address each sub-pixel.

SUMMARY

Disclosed herein is an apparatus comprising: a drive transistor, a light emitting device driven by the drive transistor; and a comparator having a first input coupled to a pixel voltage, a second input coupled to a reference voltage, a first control terminal coupled to a first control voltage, a second control terminal coupled to a second control voltage, and an output coupled to a gate of the drive transistor. The comparator is configured to output the first control voltage to the output during a first time period in which the pixel voltage is not smaller than the reference voltage and output the second control voltage to the output during a second time period in which the pixel voltage is smaller than the reference voltage. The first time period and the second time period form a drive cycle of the drive transistor, the reference voltage is a periodic alternating voltage with a cycle matching a frame cycle, and the drive cycle of the drive transistor has a drive period not longer than a period of the frame cycle.

The drive transistor is on when the gate of the drive transistor is at the first control voltage and off when the gate of the drive transistor is at the second control voltage.

The drive transistor is on when the gate of the drive transistor is at the second control voltage and off when the gate of the drive transistor is at the first control voltage.

The comparator includes an input sub-circuit, a control sub-circuit and an output sub-circuit. The input sub-circuit is coupled to the first input, the second input, the first control terminal, the second control terminal and a first node, and configured to output a first control current to the control sub-circuit via the first node during the first time period, and output a second control current to the control sub-circuit via the first node during the second time period. The control sub-circuit is coupled to the first node, the first control terminal, the second control terminal, and a second node, and configured to output the first control voltage to the second node under control of the first control current and output the second control voltage to the second node under control of the second control current. The output sub-circuit is coupled to the second node, the first control terminal, the second control terminal and the output, and configured to output the second control voltage under control of the first control voltage at the second node and output the first control voltage under control of the second control voltage at the second node.

The input sub-circuit includes a first transistor, a second transistor, a third transistor and a fourth transistor. The first transistor has a gate coupled to the first input, a first terminal coupled to the first control terminal, and a second terminal coupled to a first terminal of the third transistor. The second transistor has a gate coupled to the second input, a first terminal coupled to the first control terminal, and a second terminal coupled to the first node. The third transistor has a gate coupled to its first terminal and a gate of the fourth transistor, a second terminal coupled to the second control terminal. The fourth transistor has a first terminal coupled to the first node and a second terminal coupled to the second control terminal. The first transistor and the second transistor operate in an amplification zone and are both P-type transistors, the third transistor and the fourth transistor have identical structure and are both N-type transistors, the first control voltage is a high voltage and the second control voltage is a low voltage.

The comparator further includes a second diode coupled between the first control terminal and the input sub-circuit.

The control sub-circuit includes a first diode and a fifth transistor. The first diode has a first terminal coupled to the first control terminal and a second terminal coupled to the second node. The fifth transistor has a gate coupled to the first node, a first terminal coupled to the second control terminal, and a second terminal coupled to the second node. The fifth transistor is an N-type transistor, the first diode has a resistance greater than a resistance of the fifth transistor.

The output sub-circuit includes a sixth transistor and a seventh transistor. The sixth transistor has a gate coupled to the second node, a first terminal coupled to the first control terminal and a second terminal coupled to the output. The seventh transistor has a gate coupled to the second node, a first terminal coupled to the second control terminal and a second terminal coupled to the output. The sixth transistor is a P-type transistor and the seventh transistor is an N-type transistor.

In one frame cycle, the reference voltage is one of a triangular wave, a sawtooth wave, a positive half wave of a sine wave, and a negative half wave of a sine wave.

The apparatus may further comprise a first switch transistor and a capacitor. The first switch transistor has a gate coupled to a first scanning terminal, a first terminal coupled to a data input line, and a second terminal coupled to a first terminal of the capacitor. The capacitor has a second terminal coupled to a first voltage terminal.

The apparatus may further comprise a second switch transistor, and a lighting control transistor. The second switch transistor has a gate coupled to a second scanning terminal, a first terminal coupled to the first terminal of the capacitor, and a second terminal coupled to the first input. The drive transistor has a first terminal coupled to a second voltage terminal and a second terminal coupled to a first terminal of the lighting control transistor. The lighting control transistor has a gate coupled to the second control terminal, and a second terminal coupled to a first terminal of the light emitting device. And the light emitting device has a second terminal coupled to a third voltage terminal.

The first scanning terminal is coupled to the first control terminal, and the second scanning terminal is coupled to the second control terminal.

The light emitting device is a Micro-LED.

A display panel may comprise a plurality of sub-pixels with each sub-pixel comprising the apparatus.

At least two neighboring sub-pixels form a sub-pixel group, and the plurality of sub-pixels form a plurality of sub-pixel groups with each one sub-pixel belonging to one of the sub-pixel groups. Comparators, drive transistors and light emitting devices of one sub-pixel group are integrated on one silicon substrate. One sub-pixel group shares a reference voltage input, a second voltage input coupled to second voltage terminals, a third voltage input coupled to third voltage terminals, a first scanning input to provide the first control voltage and a second scanning input to provide the second control voltage.

Disclosed herein is a method for operating a pixel circuit, comprising: inputting a pixel voltage to a first input terminal of a comparator and inputting a reference voltage to a second input terminal of the comparator; in a first time period in which the pixel voltage is not smaller than the reference voltage, outputting a first control voltage coupled to the comparator to a gate of a drive transistor for a light emitting device; and in a second time period in which the pixel voltage is greater than the reference voltage, outputting a second control voltage coupled to the comparator to the gate of the drive transistor. The first time period and the second time period form a drive cycle of the drive transistor, the reference voltage is a periodic alternating voltage with a cycle matching a frame cycle, and the drive cycle of the drive transistor has a drive period not longer than a period of the frame cycle.

The drive transistor is on when the gate of the drive transistor is at the first control voltage and off when the gate of the drive transistor is at the second control voltage.

The drive transistor is on when the gate of the drive transistor is at the second control voltage and off when the gate of the drive transistor is at the first control voltage.

The pixel circuit is a sub-pixel and a plurality of sub-pixels form a sub-pixel group integrated on one silicon substrate.

The method further comprises inputting a first scanning voltage to the plurality of sub-pixels of the sub-pixel group to turn on a first switch transistor in each of the plurality of sub-pixel simultaneously, wherein a scanning terminal for providing the scanning voltage is also coupled to the comparator to provide the first control voltage.

Reference mark:

1-frame; 2-display panel; 21-array substrate; 211-sub-pixel; 22-encapsulation layer; 3-circuit board; 4-cover board; 11-input sub-circuit; 12-control sub-circuit; 13-output sub-circuit; 31-comparison circuit; 32-light emitting device; 100-silicon substrate chip.

DETAILED DESCRIPTION

At present, Micro LED display drive technology follows the OLED experience as a whole, namely, forming a pixel circuit on the substrate similar for driving OLED, and a drive circuit for driving the pixel circuit.

Figure 1:
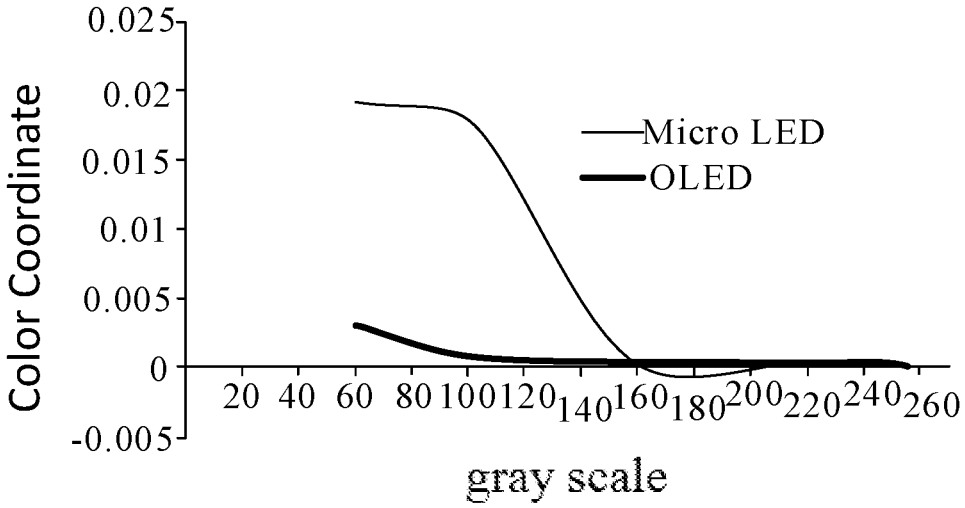
FIG. 1 schematically shows the diagram of the color coordinate changing with gray scale according to the prior art.

However, due to the difference between the device characteristics of the Micro LED and the device characteristics of the OLED, especially the variation of the color coordinate of the Micro LED based on the current, there is a serious color coordinate drift, thereby affecting the display effect. For example, as shown in FIG. 1, when a large current and a small current are switched, the color coordinate drifts with the change of the gray scale, thereby causing the actual brightness of one or more of the three primary colors to be too bright or too dark, compared to the theoretical brightness, thereby affecting the display effect.

The technical solutions in the embodiments of the present invention are clearly and completely described in the following with reference to the accompanying drawings in the embodiments of the present invention. It is obvious that the described embodiments are only a part of the embodiments of the present invention, but not all embodiments. Based on the embodiment of the invention, all other embodiments obtained by ordinary technical personnel in the field without making creative labor fall within the scope of the protection of the invention. All other embodiments obtained by those skilled in the art based on the embodiments of the present invention without creative efforts are within the scope of the present invention.

The display device may be used as a mobile phone, a tablet computer, a personal digital assistant (PDA), and a vehicle-mounted computer, etc., and the specific use of the display panel is not particularly limited in the embodiment disclosed herein.

Figure 2:
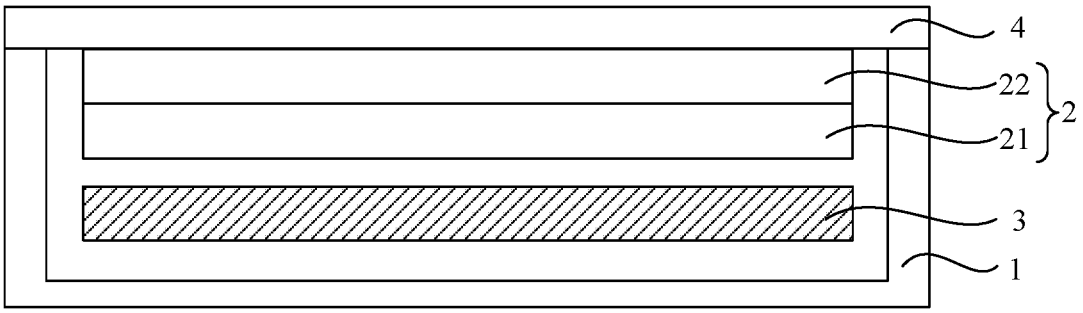
FIG. 2 schematically shows a structure diagram of a display device, according to an embodiment.

As shown in FIG. 2, the display device may include, for example, a frame 1, a display panel 2, a circuit board 3, a cover board 4, and other electronic accessories comprising a camera etc.

Taking the top light emitting display panel 2 as an example, as shown in FIG. 2, the display panel 2, the circuit board 3 are disposed in the frame 1, the circuit board 3 is disposed under the display panel 2, and the cover board 4 is disposed on the light emitting side of display panel 2.

The display panel 2 may be an OLED display panel, or a Micro LED display panel, or a quantum dot light emitting diodes (QLED) display panel.

The display panel 2 includes an array substrate 21 and an encapsulation layer 22. The array substrate 21 comprises one or more light emitting devices (LEDs) and pixel circuit for driving the LEDs to emit light.

Figure 3:
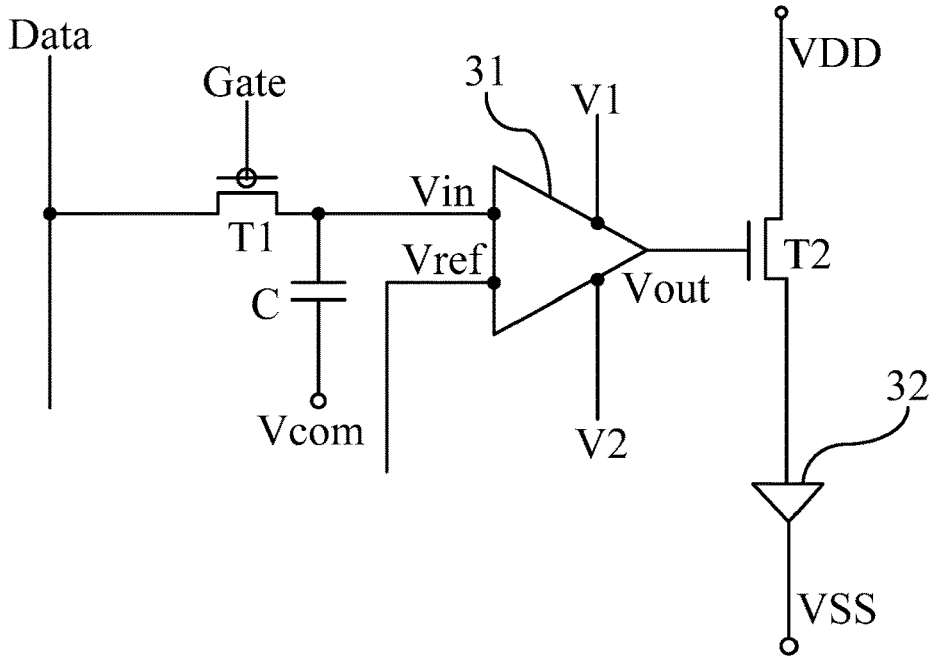
FIG. 3 schematically shows a structure diagram of a pixel circuit, according to an embodiment.

Disclosed herein provides a pixel circuit that may be used in the pixel circuit of the display panel, according to an embodiment. As shown in FIG. 3, the pixel circuit comprises a drive transistor T2, and the pixel circuit further comprises: a comparison circuit 31 (e.g., a comparator); an output terminal Vout of the comparison circuit 31, a first input terminal Vin configured to input a pixel voltage to the comparison circuit 31, a second input terminal Vref configured to input a reference voltage to the comparison circuit 31, a first control terminal V1 configured to input a first constant voltage to the comparison circuit 31, a second control terminal V2 configured to input a second constant voltage to the comparison circuit 31; the output terminal Vout is connected to the gate of the drive transistor T2.

In some embodiments, the drive transistor T2 may be an N-type transistor or a P-type transistor.

In some embodiments, the pixel circuit further comprises the light emitting device 32. The light emitting device 32 has a terminal connected to the second electrode of the drive transistor T2 and another terminal connected to the third voltage terminal VSS. The first electrode of the drive transistor T2 is connected to the second voltage terminal VDD.

Figure 4:
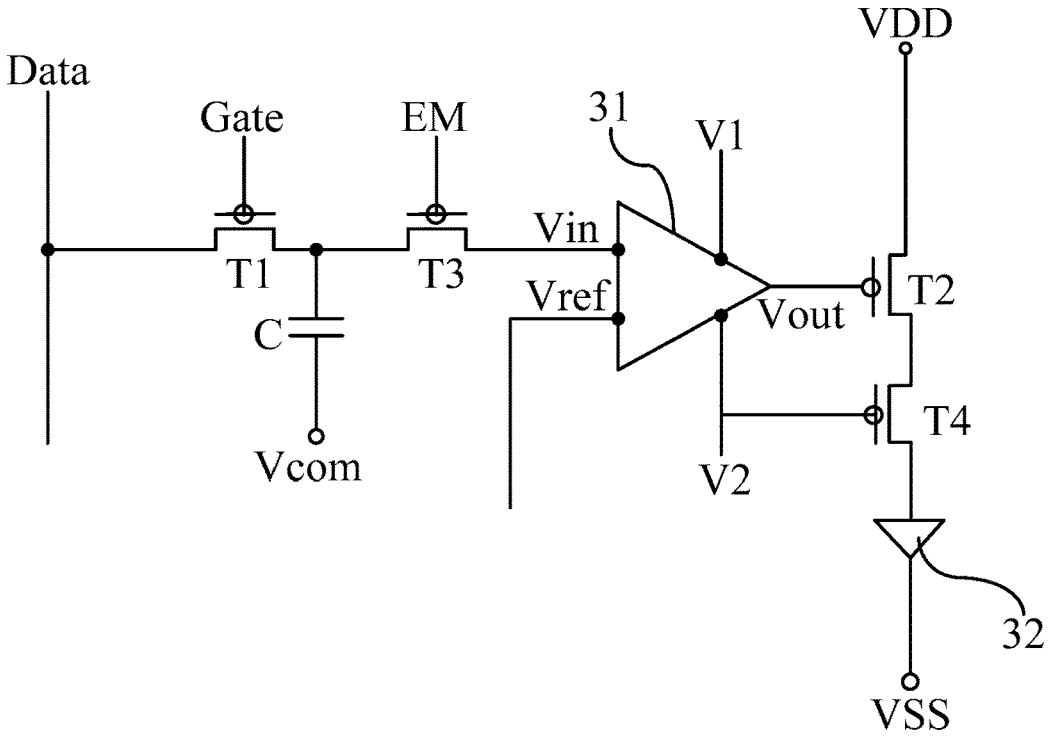
FIG. 4 schematically shows a structure diagram of a pixel circuit, according to an embodiment.

If the pixel circuit is a two-transistor-one-capacitor (2T1C) structure, the light emitting device 32 is connected directly to the second electrode of the drive transistor T2; as shown in FIG. 4, if the pixel circuit is not the 2T1C structure (for example, the pixel circuit is a four-transistor-one-capacitor (4T1C) structure), the pixel circuit further comprises a lighting control transistor T4, and the light emitting device 32 is connected indirectly to the second electrode of the drive transistor T2 through the lighting control transistor T4. Wherein, the first electrode of the lighting control transistor T4 is connected to the second electrode of the drive transistor T2, the second electrode of the lighting control transistor T4 is connected to the light emitting device 32, and the gate of the lighting control transistor T4 is connected to the second control terminal V2.

Of course, the pixel circuit may also be other structures, which are not limited in this embodiment of the present invention. For example, the pixel circuit may also be seven-transistor-one-capacitor (7T1C) etc.

The comparison circuit is configured to output the first constant voltage to the output terminal Vout during a first period in which the pixel voltage is not smaller than the reference voltage.

In some embodiments, during the first time period in which the pixel voltage is not smaller than the reference voltage, when the first constant voltage is a low level and the drive transistor T2 is a P-type transistor; or, the first constant voltage is a high level and the drive transistor T2 is an N-type transistor, the drive transistor T2 is turned on, and controls the light emitting device 32 to emit light. Otherwise, the drive transistor T2 is turned off, and the light emitting device 32 does not emit light.

In some embodiments, the first time period may be a continuous period of time in a cycle; or the first time period may also be the sum of multiple time periods that are not consecutive in a cycle.

The comparison circuit 31 is also configured to output the second constant voltage to the output terminal Vout during the second period in which the pixel voltage is smaller than the reference voltage.

In some embodiments, during a second time period in which the pixel voltage is smaller than the reference voltage, when the second constant voltage is a low level and the drive transistor T2 is a P-type transistor; or, the second constant voltage is a high level and the drive transistor T2 is an N-type transistor, the drive transistor T2 is turned on, and controls the light emitting device 32 to emit light. Otherwise, the drive transistor T2 is turned off, and the light emitting device 32 does not emit light.

In some embodiments, the second time period may be a continuous period of time in a cycle; or the second time period may also be the sum of multiple time periods that are not consecutive in a cycle.

The drive transistor T2 is turned off under the control of the first constant voltage and turned on under the control of the second constant voltage; or, the drive transistor T2 is turned on under the control of the first constant voltage and turned off under the control of the second constant voltage. The first period and the second period form a drive cycle Ti of the drive transistor T2 (T1~T3 in FIG. 5 and FIG. 6). The reference voltage is an alternating voltage that changes periodically, the period of change of the reference voltage is synchronized with the drive cycle, the drive cycle is in one-to-one correspondence with the frame cycle, and the drive period of the drive cycle is not longer than the period of the corresponding frame cycle.

Figure 5:
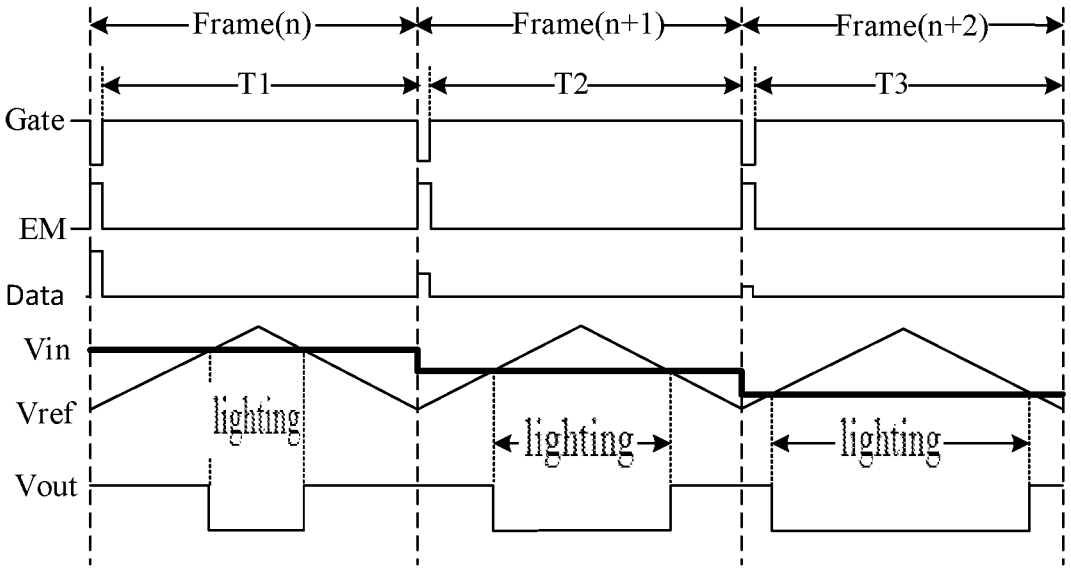
FIG. 5 schematically shows a sequence diagram of the pixel circuit shown in FIG. 4.
Figure 6:
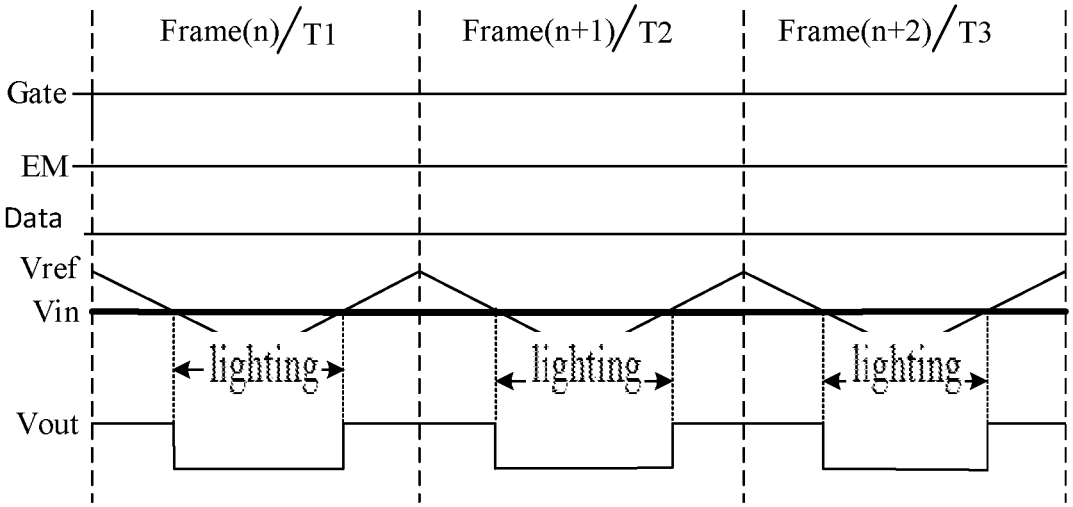
FIG. 6 schematically shows a sequence diagram of the pixel circuit shown in FIG. 3.

In some embodiments, displaying one picture has a plurality of frame cycles Frame (i) (Frame (n)~Frame (n+2) in FIG. 5 and FIG. 6), each drive cycle belongs to one frame cycle, and the drive period of the drive cycle Ti is not longer than the period of the frame cycle Frame (i) of the frame in which it is located.

For example, as shown in FIG. 4 and FIG. 5, if the pixel structure is 4T1C, the pixel circuit further comprises a first switch transistor T1, a second switch transistor T3, and a storage capacitor C. The gate of the first switch transistor T1 is connected to the first scanning terminal Gate, the first electrode of the first switch transistor T1 is connected to the data signal terminal "Data", and the second electrode of the first switch transistor T1 is connected to the first terminal of the storage capacitor C. The gate of the second switch transistor T3 is connected to the second scanning terminal EM, the first electrode of the second switch transistor T3 is connected to the first terminal of the storage capacitor C, and the second electrode of the second switch transistor T3 is connected to the first input terminal Vin; The second terminal of the storage capacitor C is connected to the first voltage terminal.

Assuming that the first switch transistor T1, the second switch transistor T3, the drive transistor T2, and the lighting control transistor T4 are all P-type transistors, the working process is as follows:

In the first phase, the first scanning terminal Gate is low level, the second scanning terminal EM and the second control terminal V2 are both high level, the first switch transistor T1 is turned on, the second switch transistor T3 and the lighting control transistor T4 are both turned off, the comparison circuit 31 does not take effect, the data signal terminal Data inputs the pixel voltage to the storage capacitor C through the first switch transistor T1.

In the second phase, the first scanning terminal Gate is high level, the second scanning terminal EM and the second control terminal V2 are both low level, the first switch transistor T1 is turned off, the second switch transistor T3 and the lighting control transistor T4 are both turned on, the comparison circuit 31 takes effect, the pixel voltage stored in the storage capacitor C input to the first input terminal Vin of the comparison circuit 31 through the second switch transistor T3.

Here, as shown in FIG. 5, the time period in which the second phase is located is a drive cycle Ti. The time period in which the first phase and the second phase are located is a frame cycle Frame (i). Wherein, the drive period of the drive cycle Ti is shorter than the period of the frame cycle Frame (i) of the frame in which it is located.

For example, as shown in FIG. 3 and FIG. 6, the pixel structure is 2T1C, and the pixel circuit further comprises the first switch transistor T1 and the storage capacitor C. The gate of the first switch transistor T1 is connected to the first scanning terminal Gate, the first electrode of the first switch transistor T1 is connected to the data signal terminal Data, and the second electrode of the first switch transistor T1 is connected to the first input terminal Vin.

Assuming that the first switch transistor T1 is a P-type transistor, and the drive transistor T2 is an N-type transistor, the working process is as follows:

The first scanning terminal Gate is low level, the first switch transistor T1 is turned on, and the drive transistor T2 is turned on, the comparison circuit 31 takes effect, the data signal terminal Data inputs the pixel voltage to the first input terminal Vin through the first switch transistor T1. Here, as shown in FIG. 6, the drive period of the drive cycle Ti is equal to the period of the frame cycle Frame (i) of the frame in which it is located.

In some embodiments, the reference voltage input by the second input terminal Vref is an alternating voltage synchronized with the drive cycle, the magnitude of which changes periodically with time, and the period of change thereof is synchronized with the drive cycle.

The pixel voltage input by the first input terminal Vin is the same in a drive cycle; the pixel voltage input by the first input terminal Vin may be the same or different in different drive cycles.

Wherein, once the magnitude and variation rule of the reference voltage are determined, the light emitting period of the light emitting device 32 may be adjusted by adjusting the magnitude of the pixel voltage input to the first input terminal Vin.

As shown in FIG. 5, assuming that the light emitting device 32 emits light while the pixel voltage input by the first input terminal Vin is smaller than the reference voltage input by the second input terminal Vref, the greater the pixel voltage input by the first input terminal Vin is, the shorter the light emitting period of the light emitting device 32 is.

As shown in FIG. 6, assuming that the light emitting device 32 emits light while the pixel voltage input by the first input terminal Vin is greater than the reference voltage input by the second input terminal Vref, and the greater the pixel voltage input by the first input terminal Vin is, the longer the light emitting period of the light emitting device 32 is.

Of course, as shown in FIG. 6, the pixel voltage input by the first input terminal Vin may also be equal in each drive cycle.

The embodiment of the invention provides a pixel circuit, comprising a comparison circuit 31 (e.g., a comparator). The comparison circuit 31 comprises a first input terminal Vin, a second input terminal Vref, and an output terminal Vout. The pixel voltage is input to the first input terminal Vin, and the reference voltage is input to the second input terminal Vref. If the pixel voltage input by the first input terminal Vin is not smaller than the reference voltage input by the second input terminal Vref, the output terminal Vout outputs a first constant voltage; if the pixel voltage input by the first input terminal Vin is smaller than the reference voltage input by the second input terminal Vref, the output terminal Vout outputs a second constant voltage. The drive transistor T2 is turned on or turned off under the control of the first constant voltage or the second constant voltage. The embodiment of the present invention may control the length of the on-time of the drive transistor T2 by controlling the magnitude of the value of the pixel voltage input by the first input terminal Vin and the corresponding duration. The longer the on-time of the drive transistor T2 in a drive cycle, the longer the light emitting period of the corresponding sub-pixel of the pixel circuit. Furthermore, the problem that the actual luminance is too bright or too dark compared to the theoretical luminance due to the color coordinate drift may be improved by adjusting the light emitting period of the sub-pixels.

Figure 7:
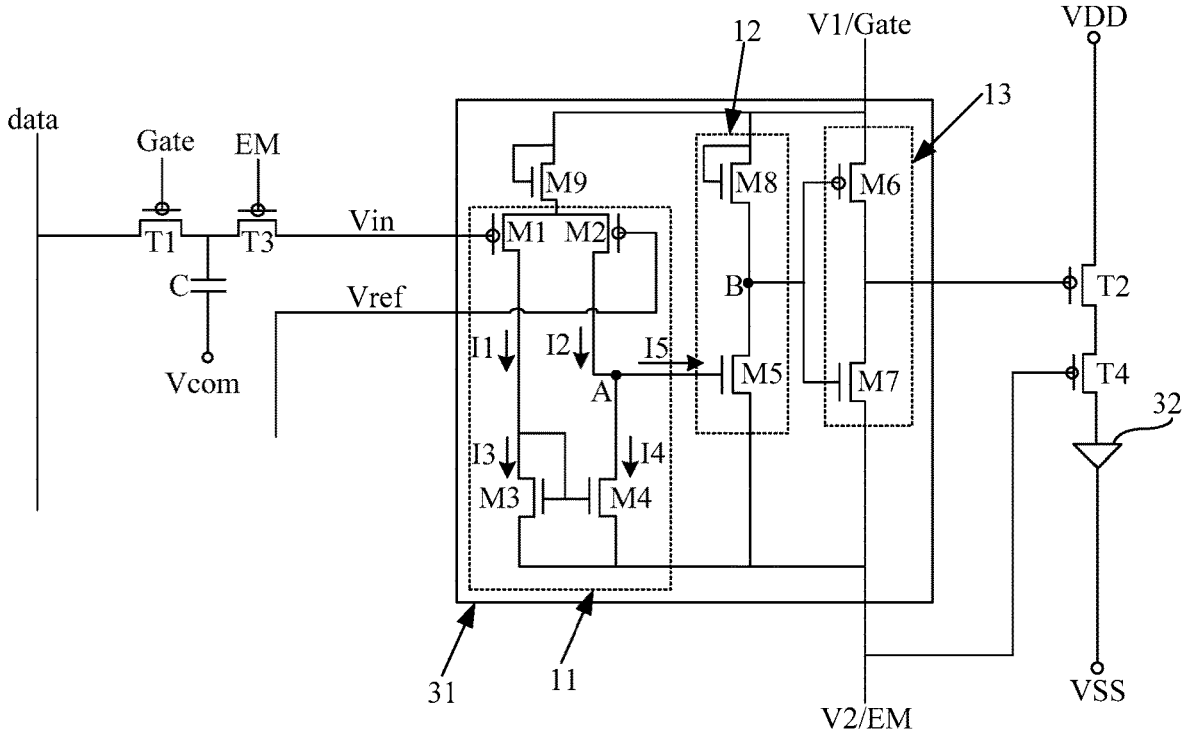
FIG. 7 schematically shows a structure diagram of a pixel circuit, according to an embodiment.

Optionally, as shown in FIG. 7, the comparison circuit 31 comprises an input sub-circuit 11, a control sub-circuit 12, and an output sub-circuit 13. The input sub-circuit 11 is connected to the first input terminal Vin, the second input terminal Vref, and the first control terminal V1, the second control terminal V2, and the first node A; the control sub-circuit 12 is connected to the first node A, the first control terminal V1, the second control terminal V2, and the second node B; the output sub-circuit 13 is connected to the second node B, the first control terminal V1, the second control terminal V2, and the output terminal Vout.

The input sub-circuit 11 is configured to output the first control current to the control sub-circuit 12 through the first node A, under the control of the pixel voltage, the reference voltage, the first constant voltage, and the second constant voltage, in the first period in which the pixel voltage input by the first input terminal Vin is not smaller than the reference voltage input by the second input terminal Vref; the control sub-circuit 12 is configured to output the first constant voltage to the second node B under the control of the first control current and the first constant voltage. The output sub-circuit 13 is configured to output a second constant voltage of the second control terminal V2 to the output terminal Vout under the control of the first constant voltage of the second node B.

Here, the input sub-circuit 11 comprises a first transistor M1, a second transistor M2, a third transistor M3, and a fourth transistor M4.

The gate of the first transistor M1 is connected to the first input terminal Vin, the first electrode of the first transistor M1 is connected to the first control terminal V1, and the second electrode of the first transistor M1 is connected to the first electrode of the third transistor M3. The gate of the second transistor M2 is connected to the second input terminal Vref, the first electrode of the second transistor M2 is connected to the first control terminal V1, and the second electrode of the second transistor M2 is connected to the first node A. The gate of the third transistor M3 is connected to the gates of the first and fourth transistors M4, and the second electrode of the third transistor M3 is connected to the second control terminal V2. The first electrode of the fourth transistor M4 is connected to the first node A, and the second electrode of the fourth transistor M4 is connected to the second control terminal V2.

Wherein, the first transistor M1 and the second transistor M2 are in an amplification region, and are both P-type transistors; the third transistor M3 and the fourth transistor M4 have the same structure, and are both N-type transistors; the first constant voltage is high level, and the second constant voltage is low level.

The control sub-circuit 12 comprises a first diode M8 and a fifth transistor M5. The first electrode of the first diode M8 is connected to the first control terminal V1, and the second electrode of the first diode M8 is connected to the second node B. The gate of the fifth transistor M5 is connected to the first node A, the first electrode of the fifth transistor M5 is connected to the second control terminal V2, and the second electrode of the fifth transistor M5 is connected to the second node B. Wherein, the fifth transistor M5 is an N-type transistor; the resistance of the first diode M8 is greater than the resistance of the fifth transistor M5.

The output sub-circuit 13 comprises a sixth transistor and a seventh transistor. The gate of the sixth transistor M6 is connected to the second node B, the first electrode of the sixth transistor M6 is connected to the first control terminal V1, and the second electrode of the sixth transistor M6 is connected to the output terminal Vout. The gate of the seventh transistor M7 is connected to the second node B, the first electrode of the seventh transistor M7 is connected to the second control terminal V2, and the second electrode of the seventh transistor M7 is connected to the output terminal Vout. The sixth transistor M6 is a P-type transistor, and the seventh transistor M7 is an N-type transistor.

When the comparison circuit (e.g., the comparator) is in operation, in the first period in which the pixel voltage input by the first input terminal Vin is not smaller than the reference voltage input by the second input terminal Vref, because the first transistor M1 and the second transistor M2 are in the amplification region, therefore, the current I1 output by the second electrode of the first transistor M1 is proportional to the pixel voltage at M1's gate, and the current I2 output by the second electrode of the second transistor M2 is proportional to the reference voltage at M2's gate, and thus I1≥I2. On this basis, because the structures of the third transistor M3 and the fourth transistor M4 are the same, the current 13 flowing through the third transistor M3 and the current I4 on the fourth transistor M4 are the same, and the current I3 flowing through the third transistor M3 is equal to the current I1 on the first transistor M1.

Wherein, the current I2 on the second transistor M2 is equal to the sum of the current I4 on the fourth transistor M4 and the current I5 on the fifth transistor M5. Since I1≥I2, the direction of the current 15 flowing on the fifth transistor M5 is from the fifth transistor M5 to the fourth transistor M4, and at the same time, the fifth transistor M5 is turned off Here, although the fifth transistor M5 is turned off, if the fifth transistor M5 is in the on state before the fifth transistor M5 is turned off, the fifth transistor M5 will store some charge, and the current flows from the fifth transistor M5 to the fourth. When the current flows from the fifth transistor M5 to the forth transistor M4, the electric charge stored in the fifth transistor M5 flows out to form the current.

The first diode M8 inputs the high level to the gate of the seventh transistor M7 through the second node B, under the control of the first constant voltage of the first control terminal V1, and controls the seventh transistor M7 to be turned on and the six-transistor M6 to be turned off. The seventh transistor M7 is turned on, and outputs a second constant voltage to the output terminal Vout through its second electrode.

On this basis, because the second constant voltage is low level, if the drive transistor T2 is a P-type transistor, the drive transistor T2 is turned on, and controls the light emitting device 32 to emit light. If the drive transistor T2 is an N-type transistor, the drive transistor T2 is turned off, and controls the light emitting device 32 to not emit light. In order to ensure the continuity of illumination in a drive cycle, the reference voltage may be a waveform as shown in FIG. 6.

In some embodiments, the first control current is the current I5 flowing through the fifth transistor M5, I5=I4-I2>0, and the direction of the current I5 flowing through the fifth transistor M5 is from the fifth transistor M5 to the fourth transistor M4.

The input sub-circuit 11 is also configured to output the second control current to the control sub-circuit 12 through the first node A, under the control of the pixel voltage, the reference voltage, the first constant voltage, and the second constant voltage, in the second period in which the pixel voltage input by the first input terminal Vin is smaller than the reference voltage input by the second input terminal Vref; the control sub-circuit 12 is also configured to output the second constant voltage to the second node B, under the control of the second control current and the first constant voltage; The output sub-circuit 13 is also configured to output the first constant voltage of the first control terminal V1 to the output terminal Vout under the control of the second constant voltage of the second node B.

When the comparison circuit (e.g., comparator) is in operation, in the second period in which the pixel voltage input by the first input terminal Vin is smaller than the reference voltage input by the second input terminal Vref, because the first transistor M1 and the second transistor M2 are in the amplification region, the current I1 output by the second electrode of the first transistor M1 is proportional to the pixel voltage input at M1's gate, and the current I2 output by the second electrode of the second transistor M2 is proportional to the reference voltage input at M2's gate, and thus I1<I2. On this basis, because the structures of the third transistor M3 and the fourth transistor M4 are the same, the current 13 flowing through the third transistor M3 and the current I4 on the fourth transistor M4 are the same, and the current I3 flowing through the third transistor M3 is equal to the current I1 on the first transistor M1.

Wherein, the current I2 on the second transistor M2 is equal to the sum of the current I4 on the fourth transistor M4 and the current I5 on the fifth transistor M5. Since I1<I2, the direction of the current I5 flowing on the fifth transistor M5 is from the second transistor M2 to the fifth transistor M5, and at the same time, the fifth transistor M5 is turned on.

The fifth transistor M5 inputs the low level to the gate of the sixth transistor M6 through the second node B under the control of the second control current, and controls the sixth transistor M6 to be turned on and the seventh transistor M7 to be turned off. The sixth transistor M6 is turned on, and outputs a first constant voltage to the output terminal Vout through its second electrode.

Here, since the resistance of the first diode M8 is greater than the resistance of the fifth transistor M5, the fifth transistor M5 is turned on to output the first constant voltage to the output terminal Vout through the second node B.

A person skilled in the art may make the resistance of the first diode M8 greater than the resistance of the fifth transistor M5 by designing the parameter of the first diode M8. At the same time, the range of resistance difference between the first diode M8 and the fifth transistor M5 may be designed according to actual needs, as long as the direction of the current IS on the fifth transistor M5 is from the second transistor M2 to the fifth transistor M5, so that the fifth transistor M5 may be turned on and the first diode M8 may be turned off On this basis, since the first constant voltage is high level, if the drive transistor T2 is a P-type transistor, the drive transistor T2 is turned off, and controls the light emitting device 32 to not emit light. If the drive transistor T2 is an N-type transistor, the drive transistor T2 is turned on, and controls the light emitting device 32 to emit light. In order to ensure the continuity of illumination in a drive cycle, the reference voltage is a waveform as shown in FIG. 5.

In some embodiments, the second control current is the current I5 flowing through the fifth transistor M5, I5=I4-I2>0, and the direction of the current I5 flowing through the fifth transistor M5 is from the second transistor M2 to the fifth transistor M5.

On the above basis, if the pixel circuit further comprises the lighting control transistor T4, in the case where the first constant voltage or the second constant voltage output by the comparison circuit 31 may turn on the drive transistor T2, the lighting control transistor T4 is also in the on-state. In the first phase of charging of the storage capacitor C (i.e., the first phase of the foregoing embodiment), in order to prevent the light emitting device 32 from emitting light erroneously, the lighting control transistor T4 is in an off state.

Wherein, considering that the gate of the lighting control transistor T4 is connected to the second control terminal V2, the second constant voltage of the second control terminal V2 is low level, therefore, the lighting control transistor T4 may be a P-type transistor.

In some embodiments, the first diode M8 may be arranged on the same layer as the first transistor M1, the second transistor M2, the third transistor M3, the fourth transistor M4, the fifth transistor M5, the sixth transistor M6, and the seventh transistor M7. In this way, the fabrication process of the pixel circuit may be simplified.

Here, the gate of the transistor is electrically connected to the source electrode (or the drain electrode) to form the first electrode of the first diode M8; the drain electrode (or the source electrode) of the transistor is the second electrode of the first diode M8.

In the embodiment of the present invention, based on the interaction between the input sub-circuit 11, the control sub-circuit 12, and the output sub-circuit 13, the output terminal Vout may output the first constant voltage or the second constant voltage, thus controlling the drive transistor T2 on or off Optionally, as shown in FIG. 7, the pixel circuit further comprises a second diode M9. The first electrode of the second diode M9 is connected to the first electrode of the first transistor M1 and the first electrode of the second transistor M2, and the second electrode of the second diode M9 is connected to the first control terminal V1.

In some embodiments, the second diode M9 may be arranged on the same layer as the first transistor M1, the second transistor M2, the third transistor M3, the fourth transistor M4, the fifth transistor M5, the sixth transistor M6, and the seventh transistor M7. In this way, the fabrication process of the pixel circuit may be simplified.

Here, the gate of the transistor is electrically connected to the source electrode (or the drain electrode) to form the first electrode of the second diode M9; the drain electrode (or the source electrode) of the transistor is the second electrode of the second diode M9.

Since during the whole display process (comprising the light emitting device emits and does not emits light), the first transistor M1 always receives the pixel voltage, and the second transistor always receives the reference voltage, its power consumption is relatively large.

Based on this, in the embodiment of the present invention, the second diode M9 is disposed in the pixel circuit, and the second diode M9 is connected to the first electrode of the first transistor M1 and the first electrode of the second transistor M2, to perform a current limiting function, thereby saving power consumption required by the pixel circuit.

Figure 8:
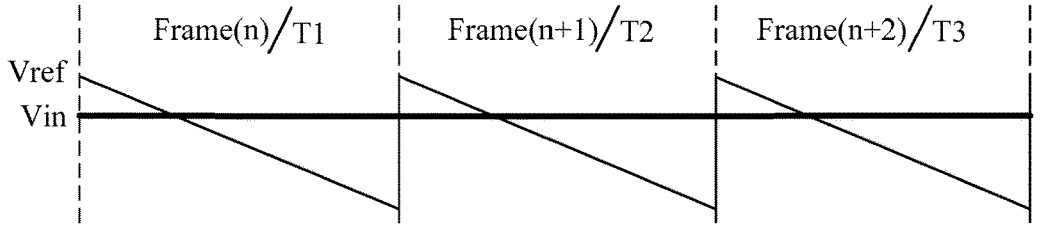
FIG. 8 schematically shows a waveform of a reference voltage, according to an embodiment.
Figure 9:
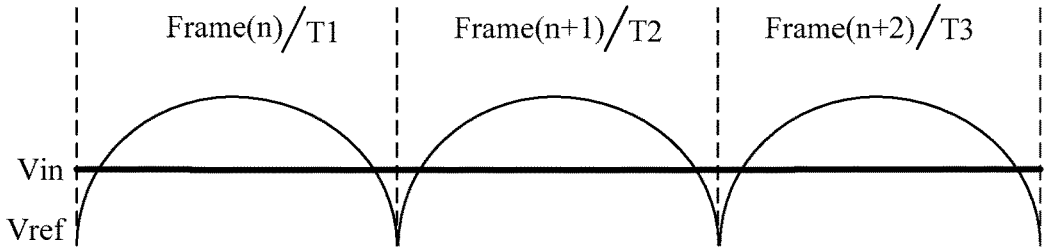
FIG. 9 schematically shows a waveform of a reference voltage, according to an embodiment.
Figure 10:
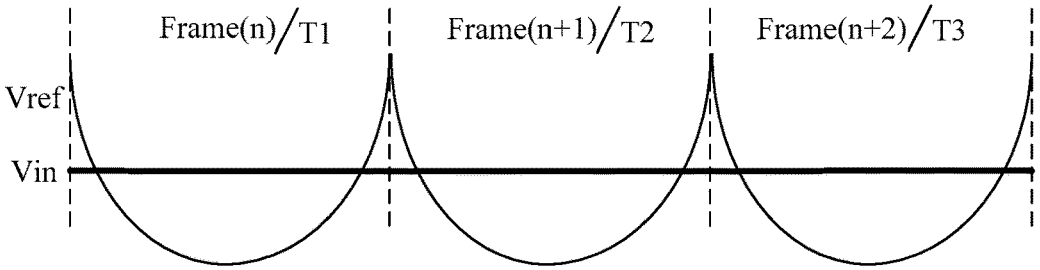
FIG. 10 schematically shows a waveform of a reference voltage, according to an embodiment.

Optionally, the waveform of the reference voltage in a frame cycle is one of a triangular wave (FIG. 5 and FIG. 6), a sawtooth wave (FIG. 8), a positive half wave of a sine wave (FIG. 9), and a negative half wave of a sine wave (FIG. 10).

In the embodiment of the present invention, considering that the pixel voltage is a constant value in a drive cycle, the reference voltage may be an alternating voltage, so that the drive cycle may include a first time period and/or a second time period to control the light emitting period of each sub-pixel in the drive cycle.

Optionally, as shown in FIG. 7, the first scanning terminal Gate is connected to the first control terminal V1, and the second scanning terminal EM is connected to the second control terminal V2.

Here, the first switch transistor T1 and the second switch transistor T3 are both P-type transistors.

In the embodiment of the present invention, when the comparison circuit 31 is in operation, the voltage of the first scanning terminal Gate and the first constant voltage of the first control terminal V1 are both at high level, the voltage of the second scanning terminal EM and the second constant voltage of the second control terminal V2 are both at low level. Therefore, the first scanning terminal Gate may be connected to the first control terminal V1, and the second scanning terminal EM may be connected to the second control terminal V2, so as to reduce the wiring between the external circuit and the pixel circuit. For each sub-pixel, two wires between the external circuit and the pixel circuit may be reduced. If the pixel circuit is applied to the display panel, the aperture ratio of the display panel may be greatly improved.

Optionally, the light emitting device 32 is a Micro LED.

In the embodiment of the present invention, when the light emitting device 32 is a Micro LED, the problem that due to the switching between the large current and the small current, the color coordinates drift, which in turn affects the display effect, may be solve with the pixel circuit.

Figure 11:
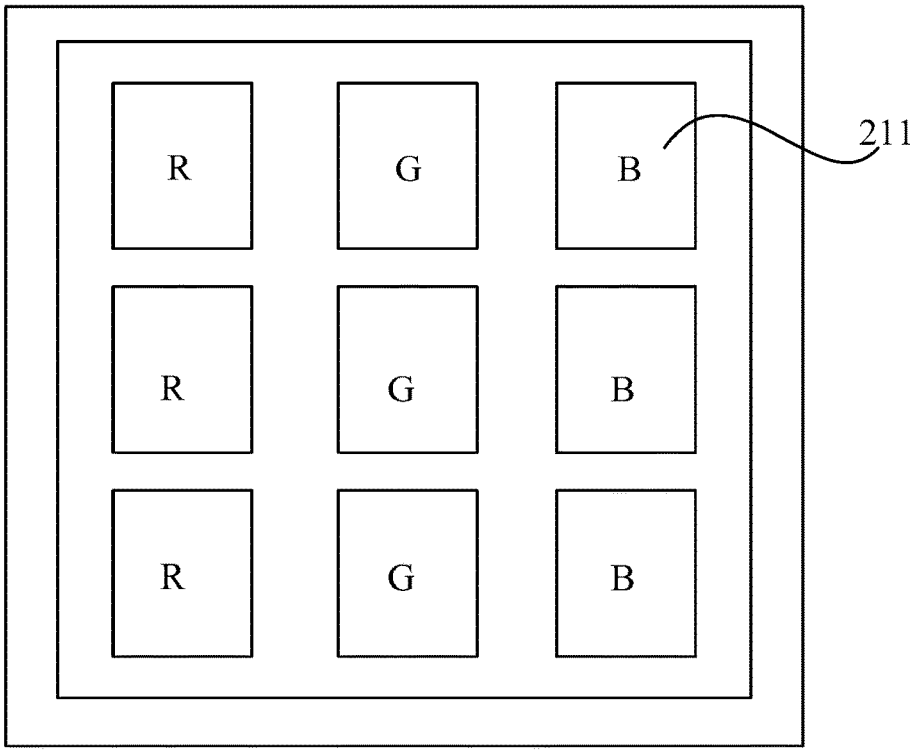
FIG. 11 schematically shows a top view of a display panel, according to an embodiment.

The embodiment of the present invention also provides a display panel 2, as shown in FIG. 11, comprising a plurality of sub-pixels 211; each sub-pixel 211 is provided with a pixel circuit as described in any of the foregoing embodiments.

Here, as shown in FIG. 11, the plurality of sub-pixels 211 comprise red sub-pixels, green sub-pixels, and blue sub-pixels; or, the plurality of sub-pixels 211 comprise magenta sub-pixels, yellow sub-pixels, and cyan sub-pixels. Based on this, the above plurality of sub-pixels 211 may also comprise white sub-pixels.

The embodiment of the present invention provides a display panel with the same explanation and the same beneficial effects as those of the foregoing pixel circuit, and details are not described herein again.

Figure 12:
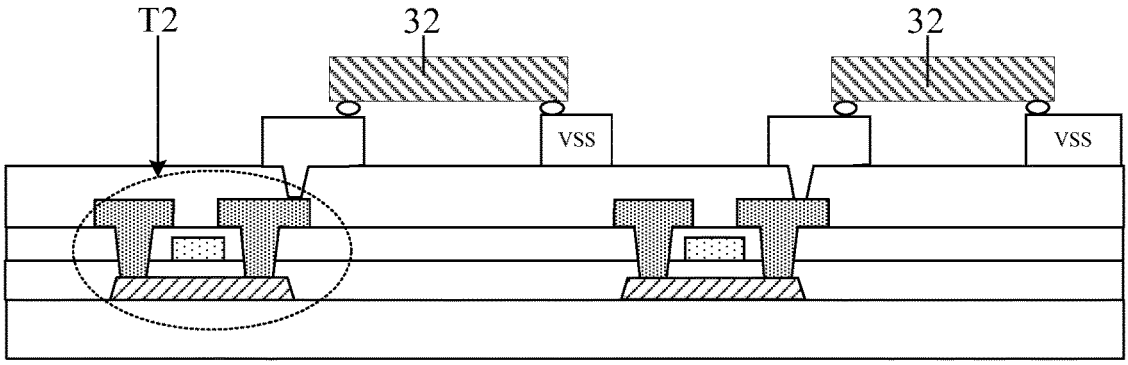
FIG. 12 schematically shows a structure diagram of a plurality of pixel circuits in a sub-pixel group, according to an embodiment.
Figure 13:
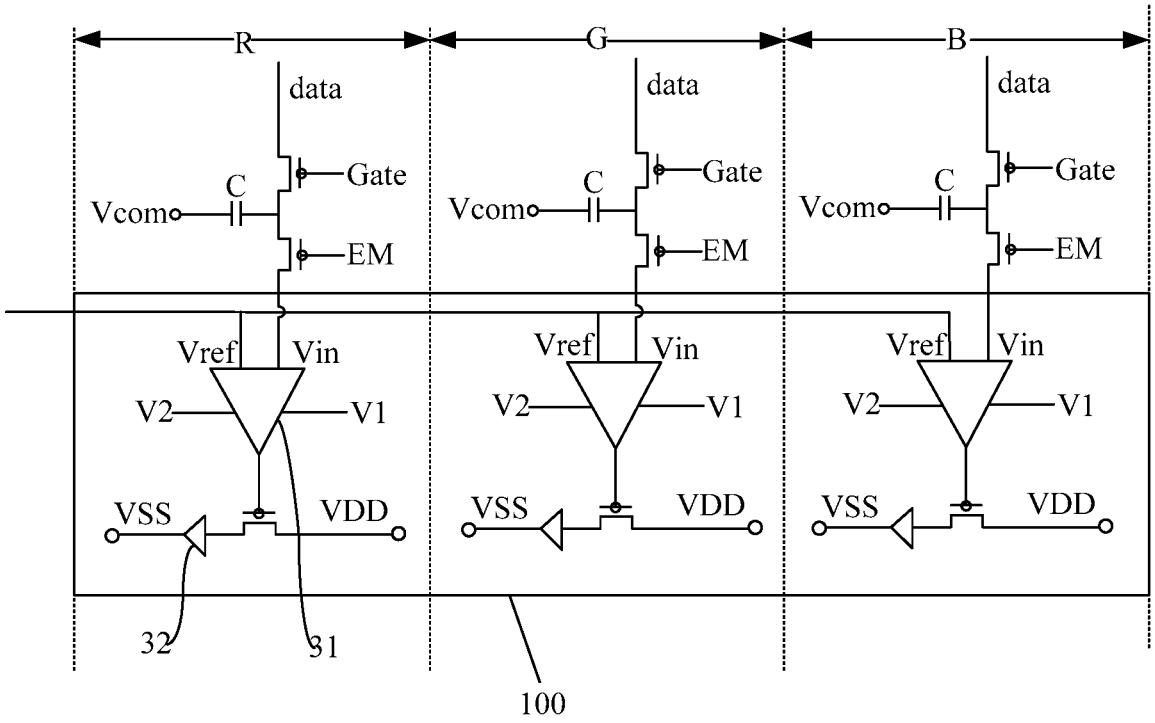
FIG. 13 schematically shows a structure diagram of a plurality of pixel circuits in a sub-pixel group, according to an embodiment.

Optionally, as shown in FIG. 12 and FIG. 13, when the light emitting device 32 is a micro light emitting diode, and the first scanning terminal Gate is connected to the first control terminal V1, and the second scanning terminal EM is connected to the second control terminal V2, then at least two adjacent sub-pixels 211 constitute a sub-pixel group, and each sub-pixel belongs to only one sub-pixel group; the comparison circuit 31, the drive transistor T2, and the light emitting device 32 of all the pixel circuits in one sub-pixel group are integrated on the same silicon substrate chip 100.

In some embodiments, a plurality of pixel circuits in a sub-pixel group may be in the same row (the first switch transistor T1 is connected to the same gate line); or, a plurality of pixel circuits in a sub-pixel group may be in different rows.

Considering the process of forming a low temperature poly-silicon (LTPS) thin film transistor on a glass substrate, it is difficult to implement the comparison circuit 31, or the performance of the prepared comparison circuit 31 is inferior.

Based on this, the embodiment of the present invention forms the comparison circuit 31 on the silicon substrate chip 100 to improve its performance. On this basis, the plurality of comparison circuits 31, the drive transistor T2, and the light emitting device 32 in a sub-pixel group may also be integrated on the same silicon substrate chip 100. In this way, in the case where the first scanning terminal Gate is connected to the first control terminal V1, and the second scanning terminal EM is connected to the second control terminal V2, the input pins of a silicon substrate chip set with a sub-pixel group only need to be respectively connected to at least one first scanning terminal Gate, at least a second scanning terminal EM, a second voltage terminal VDD, a third voltage terminal VSS, and a second input terminal Vref, which may greatly reduce the number of input pins of the silicon substrate chip, thereby reducing the number of the wires in the display area of the display panel 2, thereby increasing the aperture ratio of the display panel 2, compared with the existing technology that the input pins for one sub-pixel are respectively connected to a first scan terminal Gate, a second scan terminal EM, a second voltage terminal VDD, a third voltage terminal VSS, and a second input terminal Vref.

Optionally, the pixel circuit comprises a first switch transistor T1; the first scanning terminal Gate is connected to the first control terminal V1; the second scanning terminal V2 is connected to the second control terminal EM; and the switch transistor T1 is simultaneously turned on for all sub-pixels in a sub-pixel group.

Namely, the first switch transistors T1 of all sub-pixels in one sub-pixel group are located in the same row.

In the embodiment of the present invention, since the gate lines open line by line, and scan line by line, during the display process, the input pin of one silicon substrate chip 100 may be connected only to one first scanning terminal Gate and one second scanning terminal EM by simultaneously turning on the first switch transistor T1 of all the sub-pixels in a sub-pixel group, to further reduce the number of input pins of the silicon substrate chip 100, thereby increasing the aperture ratio of the display panel 2.

Figure 14:
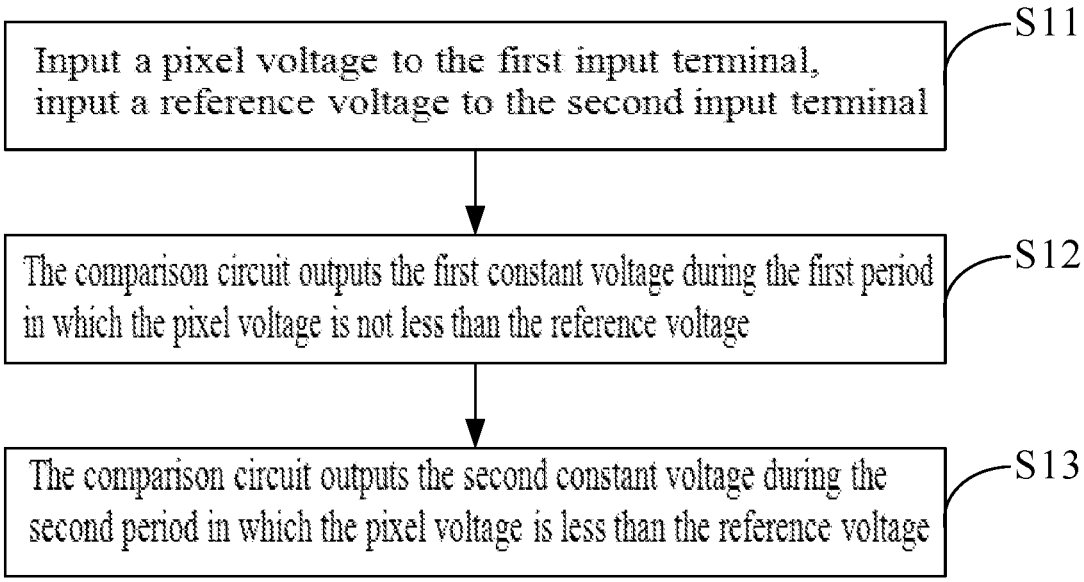
FIG. 14 schematically shows a flow chart for driving the pixel circuit, according to an embodiment.

The embodiment of the present invention further provides a drive method of a pixel circuit according to any of the foregoing embodiments. As shown in FIG. 14, the following steps may be implemented:

S11, input a pixel voltage to the first input terminal Vin of the comparison circuit 31, and input a reference voltage to the second input terminal Vref of the comparison circuit 31.

512, the comparison circuit 31 outputs the first constant voltage during the first period in which the pixel voltage is not smaller than the reference voltage.

In some embodiments, during the first period in which the pixel voltage is not smaller than the reference voltage, when the first constant voltage is low level and the drive transistor T2 is a P-type transistor; or the first constant voltage is high level and the drive transistor T2 is an N-type transistor, the drive transistor T2 is turned on, and controls the light emitting device 32 to emit light. Otherwise, the drive transistor T2 is turned off, and the light emitting device 32 does not emit light.

In some embodiments, the first time period may be a continuous period of time in a cycle; or the first time period may also be the sum of multiple discontinuous periods of time in a cycle.

S13, the comparison circuit 31 outputs a second constant voltage during the second period in which the pixel voltage is smaller than the reference voltage.

In some embodiments, during the second period in which the pixel voltage is smaller than the reference voltage, when the second constant voltage is low level and the drive transistor T2 is a P-type transistor; or the second constant voltage is high level and the drive transistor T2 is an N-type transistor, the drive transistor T2 is turned on, and controls the light emitting device 32 to emit light. Otherwise, the drive transistor T2 is turned off, and the light emitting device 32 does not emit light.

In some embodiments, the second time period may be a continuous period of time in a cycle; or the second time period may also be the sum of multiple discontinuous periods of time in a cycle.

The first period and the second period form a drive cycle of the drive transistor T2; the reference voltage is an alternating voltage that changes periodically, the period of change of the reference voltage is synchronized with the frame cycle, the drive cycle is in one-to-one correspondence with the frame cycle, and the drive period of the drive cycle is not longer than the period of the corresponding frame cycle.

In some embodiments, displaying one picture has a plurality of frame cycles Frame (i) (Frame (n)~Frame (n+2) in FIG. 5 and FIG. 6), each drive cycle belongs to a frame cycle, and the drive period of a drive cycle Ti is not longer than the period of the frame cycle Frame (i) of the frame in which it is located.

For example, as shown in FIG. 4 and FIG. 5, if the pixel structure is 4T1C, the pixel circuit further comprises a first switch transistor T1, a second switch transistor T3, and a storage capacitor C. The gate of the first switch transistor T1 is connected to the first scanning terminal Gate, the first electrode of the first switch transistor T1 is connected to the data signal terminal Data, and the second electrode of the first switch transistor T1 is connected to the first terminal of the storage capacitor C; the gate of the second switch transistor T3 is connected to the second scanning terminal EM, the first electrode of the second switch transistor T3 is connected to the first terminal of the storage capacitor C, and the second electrode of the second switch transistor T3 is connected to the first input terminal Vin; the second terminal of the storage capacitor C is connected to the first voltage terminal.

Assuming that the first switch transistor T1, the second switch transistor T3, the drive transistor T2, and the lighting control transistor T4 are all P-type transistors, the working process is as follows:

In the first phase, the first scanning terminal Gate is at low level, the second scanning terminal EM and the second control terminal V2 are both at high level, the first switch transistor T1 is turned on, the second switch transistor T3 and the lighting control transistor T4 are both turned off, the comparison circuit 31 does not take effect, the data signal terminal Data inputs the pixel voltage to the storage capacitor C through the first switch transistor T1.

In the second phase, the first scanning terminal Gate is at high level, the second scanning terminal EM and the second control terminal V2 are both at low level, the first switch transistor T1 is turned off, the second switch transistor T3 and the lighting control transistor T4 are both turned on, the comparison circuit 31 takes effect, the pixel voltage stored in the storage capacitor C may be input to the first input terminal Vin of the comparison circuit 31 through the second switch transistor T3.

Here, as shown in FIG. 5, the time period in which the second phase is located is a drive cycle Ti. The time period in which the first phase and the second phase are located is a frame cycle Frame (i). Wherein, the drive period of the drive cycle Ti is shorter than the period of the frame cycle Frame (i) of the frame in which it is located.

For example, as shown in FIG. 3 and FIG. 6, the pixel structure is 2T1C, and the pixel circuit further comprises the first switch transistor T1 and the storage capacitor C. The gate of the first switch transistor T1 is connected to the first scanning terminal Gate, the first electrode of the first switch transistor T1 is connected to the data signal terminal Data, and the second electrode of the first switch transistor T1 is connected to the first input terminal Vin.

Assuming that the first switch transistor T1 is a P-type transistor, and the drive transistor T2 is an N-type transistor, the working process is as follows:

The first scanning terminal Gate is at low level, the first switch transistor T1 is turned on, and the drive transistor T2 is turned on, the comparison circuit 31 takes effect, the data signal terminal Data inputs the pixel voltage to the first input terminal Vin through the first switch transistor T1. Here, as shown in FIG. 6, the drive period of the drive cycle Ti is equal to the period of the frame cycle Frame (i) of the frame in which it is located.

In some embodiments, the reference voltage input by the second input terminal Vref is an alternating voltage synchronized with the drive cycle, the magnitude of which changes periodically with time, and the period of change thereof is synchronized with the drive cycle.

The pixel voltage input by the first input terminal Vin is the same in a drive cycle; the pixel voltage input by the first input terminal Vin may be the same or different in different drive cycles.

Wherein, once the magnitude and variation rule of the reference voltage are determined, the light emitting period of the light emitting device 32 may be adjusted by adjusting the magnitude of the pixel voltage input to the first input terminal Vin.

As shown in FIG. 5, assuming that the light emitting device 32 emits light while the pixel voltage input by the first input terminal Vin is smaller than the reference voltage input by the second input terminal Vref, the greater the pixel voltage input by the first input terminal Vin is, the shorter the light emitting period of the light emitting device 32 is.

As shown in FIG. 6, assuming that the light emitting device 32 emits light while the pixel voltage input by the first input terminal Vin is greater than the reference voltage input by the second input terminal Vref, the greater the pixel voltage input by the first input terminal Vin is, the longer the light emitting period of the light emitting device 32 is.

Of course, as shown in FIG. 6, the pixel voltage input by the first input terminal Vin may also be equal in each drive cycle.

The embodiment of the present invention provides a drive method of the pixel circuit with the same beneficial effects as those of the foregoing pixel circuit, and details are not described herein again.

What is claimed is:

1. An apparatus, comprising:

a drive transistor;

a light emitting device driven by the drive transistor; and a comparator having a first input coupled to a pixel voltage, a second input coupled to a reference voltage, a first control terminal coupled to a first control voltage, a second control terminal coupled to a second control voltage, and an output coupled to a gate of the drive transistor, wherein the comparator is configured to output the first control voltage to the output during a first time period in which the pixel voltage is not smaller than the reference voltage and output the second control voltage to the output during a second time period in which the pixel voltage is smaller than the reference voltage, wherein the first time period and the second time period form a drive cycle of the drive transistor, the reference voltage is a periodic alternating voltage with a cycle matching a frame cycle, and the drive cycle of the drive transistor has a drive period not longer than a period of the frame cycle, and wherein the comparator includes an input sub-circuit, a control sub-circuit and an output sub-circuit, the input sub-circuit is coupled to the first input, the second input, the first control terminal, the second control terminal and a first node, and configured to output a first control current to the control sub-circuit via the first node during the first time period, and output a second control current to the control sub-circuit via the first node during the second time period, the control sub-circuit is coupled to the first node, the first control terminal, the second control terminal, and a second node, and configured to output the first control voltage to the second node under control of the first control current and output the second control voltage to the second node under control of the second control current, the output sub-circuit is coupled to the second node, the first control terminal, the second control terminal and the output, and configured to output the second control voltage under control of the first control voltage at the second node and output the first control voltage under control of the second control voltage at the second node.

2. The apparatus of claim 1, wherein the drive transistor is on when the gate of the drive transistor is at the first control voltage and off when the gate of the drive transistor is at the second control voltage.

3. The apparatus of claim 1, wherein the drive transistor is on when the gate of the drive transistor is at the second control voltage and off when the gate of the drive transistor is at the first control voltage.

4. The apparatus of claim 1, wherein the input sub-circuit includes a first transistor, a second transistor, a third transistor and a fourth transistor, wherein the first transistor has a gate coupled to the first input, a first terminal coupled to the first control terminal, and a second terminal coupled to a first terminal of the third transistor, wherein the second transistor has a gate coupled to the second input, a first terminal coupled to the first control terminal, and a second terminal coupled to the first node, wherein the third transistor has a gate coupled to its first terminal and a gate of the fourth transistor, a second terminal coupled to the second control terminal, wherein the fourth transistor has a first terminal coupled to the first node and a second terminal coupled to the second control terminal, wherein the first transistor and the second transistor operate in an amplification zone and are both P-type transistors, the third transistor and the fourth transistor have identical structure and are both N-type transistors, the first control voltage is a high voltage and the second control voltage is a low voltage.

5. The apparatus of claim 1, wherein the comparator further includes a second diode coupled between the first control terminal and the input sub-circuit.

6. The apparatus of claim 1, wherein the control sub-circuit includes a first diode and a fifth transistor, the first diode has a first terminal coupled to the first control terminal and a second terminal coupled to the second node, and the fifth transistor has a gate coupled to the first node, a first terminal coupled to the second control terminal, and a second terminal coupled to the second node, the fifth transistor is an N-type transistor, the first diode has a resistance greater than a resistance of the fifth transistor.

7. The apparatus of claim 1, wherein the output sub-circuit includes a sixth transistor and a seventh transistor, the sixth transistor has a gate coupled to the second node, a first terminal coupled to the first control terminal and a second terminal coupled to the output, the seventh transistor has a gate coupled to the second node, a first terminal coupled to the second control terminal and a second terminal coupled to the output, the sixth transistor is a P-type transistor and the seventh transistor is an N-type transistor.

8. The apparatus of claim 1, wherein, in one frame cycle, the reference voltage is one of a triangular wave, a sawtooth wave, a positive half wave of a sine wave, and a negative half wave of a sine wave.

9. The apparatus of claim 1 wherein the light emitting device is a Micro-LED.

10. An apparatus, comprising:

a drive transistor;

a light emitting device driven by the drive transistor;

a first switch transistor and a capacitor;

a second switch transistor, and a lighting control transistor; and a comparator having a first input coupled to a pixel voltage, a second input coupled to a reference voltage, a first control terminal coupled to a first control voltage, a second control terminal coupled to a second control voltage, and an output coupled to a gate of the drive transistor, wherein the comparator is configured to output the first control voltage to the output during a first time period in which the pixel voltage is not smaller than the reference voltage and output the second control voltage to the output during a second time period in which the pixel voltage is smaller than the reference voltage, wherein the first time period and the second time period form a drive cycle of the drive transistor, the reference voltage is a periodic alternating voltage with a cycle matching a frame cycle, and the drive cycle of the drive transistor has a drive period not longer than a period of the frame cycle, wherein the first switch transistor has a gate coupled to a first scanning terminal, a first terminal coupled to a data input line, and a second terminal coupled to a first terminal of the capacitor, wherein the capacitor has a second terminal coupled to a first voltage terminal, wherein the second switch transistor has a gate coupled to a second scanning terminal, a first terminal coupled to the first terminal of the capacitor, and a second terminal coupled to the first input, wherein the drive transistor has a first terminal coupled to a second voltage terminal and a second terminal coupled to a first terminal of the lighting control transistor, wherein the lighting control transistor has a gate coupled to the second control terminal, and a second terminal coupled to a first terminal of the light emitting device, and the light emitting device has a second terminal coupled to a third voltage terminal.

11. The apparatus of claim 10, wherein the first scanning terminal is coupled to the first control terminal, and the second scanning terminal is coupled to the second control terminal.

12. The apparatus of claim 10, wherein the drive transistor is on when the gate of the drive transistor is at the first control voltage and off when the gate of the drive transistor is at the second control voltage.

13. The apparatus of claim 10, wherein the drive transistor is on when the gate of the drive transistor is at the second control voltage and off when the gate of the drive transistor is at the first control voltage.

14. The apparatus of claim 10, wherein, in one frame cycle, the reference voltage is one of a triangular wave, a sawtooth wave, a positive half wave of a sine wave, and a negative half wave of a sine wave.

15. The apparatus of claim 10, wherein the light emitting device is a Micro-LED.

16. A display panel, comprising a plurality of sub-pixels with each sub-pixel comprising an apparatus that comprises:

a drive transistor;

a light emitting device driven by the drive transistor; and a comparator having a first input coupled to a pixel voltage, a second input coupled to a reference voltage, a first control terminal coupled to a first control voltage, a second control terminal coupled to a second control voltage, and an output coupled to a gate of the drive transistor, wherein the comparator is configured to output the first control voltage to the output during a first time period in which the pixel voltage is not smaller than the reference voltage and output the second control voltage to the output during a second time period in which the pixel voltage is smaller than the reference voltage, wherein the first time period and the second time period form a drive cycle of the drive transistor, the reference voltage is a periodic alternating voltage with a cycle matching a frame cycle, and the drive cycle of the drive transistor has a drive period not longer than a period of the frame cycle, wherein at least two neighboring sub-pixels form a sub-pixel group, and the plurality of sub-pixels form a plurality of sub-pixel groups with each one sub-pixel belonging to one of the sub-pixel groups, wherein comparators, drive transistors and light emitting devices of one sub-pixel group are integrated on one silicon substrate, wherein one sub-pixel group shares a reference voltage input, a second voltage input coupled to second voltage terminals, a third voltage input coupled to third voltage terminals, a first scanning input to provide the first control voltage and a second scanning input to provide the second control voltage.

17. The display panel of claim 16, wherein the drive transistor is on when the gate of the drive transistor is at the first control voltage and off when the gate of the drive transistor is at the second control voltage.

18. The display panel of claim 16, wherein the drive transistor is on when the gate of the drive transistor is at the second control voltage and off when the gate of the drive transistor is at the first control voltage.

19. The display panel of claim 16, wherein, in one frame cycle, the reference voltage is one of a triangular wave, a sawtooth wave, a positive half wave of a sine wave, and a negative half wave of a sine wave.

20. The display panel of claim 16, wherein the light emitting device is a Micro-LED.

* * * * *